US006176311B1

(12) United States Patent
Ryan

(10) Patent No.: US 6,176,311 B1
(45) Date of Patent: Jan. 23, 2001

(54) DOWNHOLE CUTTING SEPARATOR

(75) Inventor: Jimmy Don Ryan, Houma, LA (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/179,488

(22) Filed: Oct. 27, 1998

Related U.S. Application Data

(60) Provisional application No. 60/063,397, filed on Oct. 27, 1997.

(51) Int. Cl.[7] ..... E21B 31/08
(52) U.S. Cl. ..... 166/99; 175/215
(58) Field of Search ..... 166/99, 105.3, 166/105.5, 107, 167; 175/215, 308, 312

(56) References Cited

U.S. PATENT DOCUMENTS

| | | | | |
|---|---|---|---|---|
| 1,741,497 | | 12/1929 | Boltz . | |
| 2,332,267 | * | 10/1943 | Sewell | 175/312 X |
| 2,550,080 | | 4/1951 | Moore . | |
| 2,675,879 | * | 4/1954 | Middleton et al. | 175/312 X |
| 2,710,741 | * | 6/1955 | Hall, Sr. | 166/99 |
| 2,894,725 | * | 7/1959 | Baker | 166/99 |
| 2,908,332 | | 10/1959 | Nedow . | |
| 3,102,600 | | 9/1963 | Jackson . | |
| 3,648,788 | | 3/1972 | McKinney . | |
| 4,059,155 | | 11/1977 | Greer . | |
| 4,276,931 | * | 7/1981 | Murray | 166/99 |
| 4,296,822 | | 10/1981 | Ormsby . | |
| 5,035,291 | | 7/1991 | Shields . | |
| 5,176,208 | * | 1/1993 | Lalande et al. | 166/99 |
| 5,402,850 | * | 4/1995 | Lalande et al. | 166/301 |
| 5,682,950 | | 11/1997 | Bjørnstad . | |

OTHER PUBLICATIONS

Baker Oil Tools Fishing Services General Catalogue, Boot Basket, p. 25.

Composite Catalogue 90–91, The Red Baron, Junk Subs (Boot Baskets).

Baker Oil Tools Fishing Services General Catalogue, Globe Type Junk Basket, p. 26.

Baker Oil Tools Fishing Services General Catalogue, Hydraulic Junk Basket, p. 27.

Composite Catalogue, Houston Engineers, Inc., Jet Junk Basket, p. 16.

Composite Catalogue, Bowen Oil Tools, Bowen Reverse Circulation Junk Baskets, p. 34.

Composite Catalogue, Bowen Oil Tools, Bowen Full–Flow Reverse Circulation Junk Baskets, p. 35.

Baker Oil Tools Fishing Services General Catalogue, Combination Ball Type Jet and Junk Basket, p. 28.

Baker Oil Tools Fishing Services General Catalogue, Jet Bushing, p. 29.

Baker Oil Tools Fishing Services General Catalogue, "M" Reverse Circulating Tool, p. 30.

* cited by examiner

*Primary Examiner*—Frank S. Tsay
(74) *Attorney, Agent, or Firm*—Duane, Morris & Heckscher LLP

(57) ABSTRACT

A downhole cutting separator is disclosed. The separator can be mounted anywhere on the drillstring. The separator employs a seal which directs the normally circulating fluid during the cutting or milling operation in through an internal passage in the tool. The cutting-laden fluid passes through a slotted liner where the cuttings drop out and are collected in a compartment within the tool. The circulating fluid exits the tool into the annulus. The tools can be used in series so that the lowermost tool takes out the large cuttings, while an upper tool takes out finer cuttings. Provisions can be made to bypass the tool should it become plugged with cuttings by using rupture discs or movable sleeves responsive to pressure differential. A portion of the body assembly can be magnetic to further assist in removal of cuttings as the circulating flow passes through the tool.

20 Claims, 4 Drawing Sheets

DOWNHOLE CUTTING SEPARATOR

This application claim the benefit of U.S. provisional application Ser. No. 60/063,397, filed on Oct. 27, 1997.

FIELD OF THE INVENTION

The field of this invention relates to downhole devices for capturing cuttings from return fluid.

BACKGROUND OF THE INVENTION

When milling metallic objects downhole, cuttings are generated which must be removed from the wellbore. Cuttings that aren't captured near the milling can go uphole and lodge in undesirable places, such as the BOP rams, flow control devices, and pump liners.

In the past, various types of devices have been used to capture cuttings during milling. One such example is a "Boot Basket," product No. 130-16 offered by Baker Oil Tools. This type of tool relies on the sudden decrease in annular velocity when the cuttings pass the larger O.D. of the boot, reaching the smaller O.D. of the body and the top connection. This slowdown in velocity allows some of the flow to come back around into the basket area where the cuttings can be trapped. Similar tools are offered from Red Barron and are called "junk subs." Other designs are called "globe-type junk baskets" offered by Baker Oil Tools, which comprise a hollow milling head and a double set of free-rotating finger catchers, a middle body, and a top sub. In operation, a core is cut from the formation, and any junk that may have obstructed normal drilling should be recovered above the core. This type of design is primarily used in open-hole, due to its inability to produce any reverse circulating action or vacuum. Hydraulic Junk Basket, product No. 130-73, offered by Baker Oil Tools, provides for movable sleeves which, in turn, rotate a catcher down and under the junk that has accumulated within the body. A similar tool is offered by Houston Engineers Inc. as the H-E Jet Junk Basket. Other types of junk baskets, such as those offered by Bowen, employ reverse circulation. In this type of tool, the flow is directed from inside the tool to the outside, around the bottom, through the junk catcher, and out again through the annular space.

Yet another type of retrieval tool for cuttings is the combination Ball-type Jet and Junk Basket, product No. 130-97, offered by Baker Oil Tools. it uses reverse circulation and coring ability to allow two junk recovery operations in a single run. In the first operation, using high velocity, the tool jet assembly diverts the drilling fluid out of the jet nozzles, down the O.D. of the tool. The fluid goes up through the bottom of the tool and forces any junk items, such as bit cones and hand tools, up into the I.D. of the bushing. The caught debris is held by the catchers attached to the tool. To complete the recovery, the tool is rotated and lowered into the formation to core up any remaining junk. Yet another product offered by Baker Oil Tools is the Jet Bushing, product No. 130-96, which uses high-velocity fluid through the jets to create a vacuum inside the barrel of the tool which causes a reverse circulating effect. The reverse circulation action makes it possible to recover junk without cutting a core. The housing has several junk retention cups so that as the fluid is pumped up the hole, the cups act as internal junk baskets.

As fluid passes over these internal projections, the flow velocity is reduced at the top of each projection, causing the loose junk to be released from the fluid stream. Those cuttings which are not removed from the fluid stream are carried up to the jetting assembly and are either flushed uphole or recirculated downhole. Yet another tool in this area is the M Reverse Circulating Tool, offered by Baker Oil Tools. This tool employs a rubber cup seal that ensures that 100% of the flow going down the drillstring is forced downward on the outside of the junk retrieving pipe. The junk is carried up the inside of the junk retrieving pipe, filtered by a screen, and then the clean fluid is directed out of the tool above the cup. The typical use for this tool is for milling over packers and the milling head is driven by a length of casing rather than drillpipe.

It is an object of the present invention to avoid having to use reverse circulation and, instead, employ through-the-drillpipe circulation to allow the tool to be run with bottom-end tools that have small circulation ports. It is another object of the tool to allow the use of large access ports to efficiently capture the cuttings. This is in distinction to the known designs described above which employed very small ports which limited the ability of the cuttings to enter the cutting retention systems. It is a further object to provide a tool that can be run in any position on the drillstring, as opposed to only on the bottom which is where the prior art designs were located.

Another object of the tool is that it can be run with several of them in series where the first tool removes larger cuttings, and a tool above can remove fine cuttings.

SUMMARY OF THE INVENTION

A downhole cutting separator is disclosed. The separator can be mounted anywhere on the drillstring. The separator employs a seal which directs the normally circulating fluid during the cutting or milling operation in through an internal passage in the tool. The cutting-laden fluid passes through a slotted liner where the cuttings drop out and are collected in a compartment within the tool. The circulating fluid exits the tool into the annulus. The tools can be used in series so that the lowermost tool takes out the large cuttings, while an upper tool takes out finer cuttings. Provisions can be made to bypass the tool should it become plugged with cuttings by using rupture discs or movable sleeves responsive to pressure differential. A portion of the body assembly can be magnetic to further assist in removal of cuttings as the circulating flow passes through the tool.

DETAILED DESCRIPTION OF THE PREFERRED EMBODIMENT

Figure 1A:
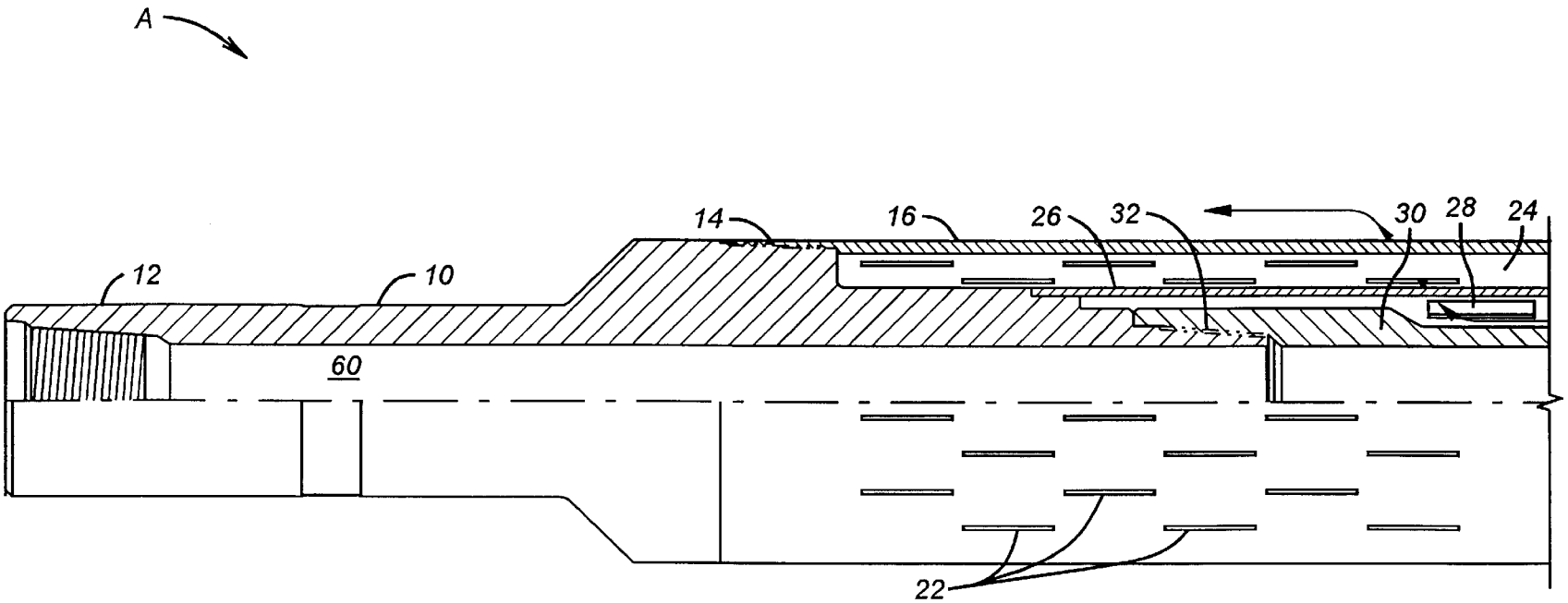
FIGS. 1*a* and 1*b* are a sectional elevational view of the tool, showing its various components.
Figure 1B:
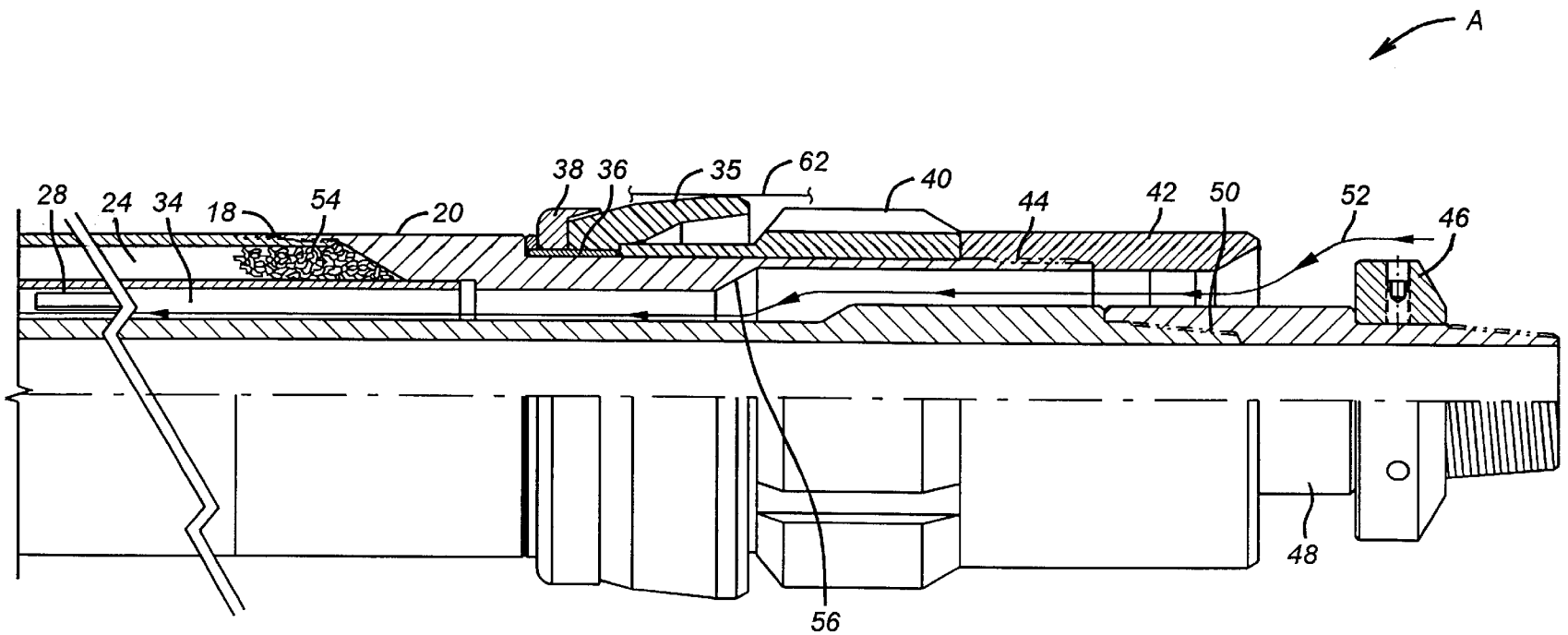

The apparatus A of the present invention is illustrated in FIGS. 1*a* and 1*b*. A top sub 10 is connected to the drillstring (not shown) at thread 12. Top sub 10 has an outermost threaded connection 14 to which a slotted liner 16 is secured. Another thread 18 secures the lower end of the slotted liner 16 to the body 20. The slots 22 are in the upper end of the slotted liner 16. Slots 22 can take any shape without departing from the spirit of the invention. An annular space 24 is defined between the slotted liner 16 and an inner sleeve 26. Inner sleeve 26 has a series of openings 28. Openings 28 are shown as slots, but any other shape can be used without departing from the spirit of the invention.

Top sub 10 is connected to body 30 at thread 32. An annular space 34 is defined between the body 30 and the inner sleeve 26. Body 20 has a cup seal 35 which is mounted on a bearing 36. Bearing 36 is retained by top bearing cap assembly 38. To facilitate insertion and assembly, a guide 40 is secured to body 20 below the cup seal 35, and a circulation sub 42 secures the entire assembly to body 20 by connection at thread 44.

A stop ring 46 is connected to a stop sub 48. Stop sub 48 is connected to body 30 at thread 50.

Arrow 52 represents the flow of circulating fluid bearing the cuttings through the apparatus A. The flow represented by arrow 52 enters annular space 34 and eventually passes through openings 28 into annular space 24. At this point, the cuttings 54 drop out to the bottom of annular space 24, while the fluid passes through openings or slots 22. Those skilled in the art will appreciate that multiple assemblies of the apparatus A can be used in series such that the assembly, as shown in FIGS. 1*a* and 1*b*, can have larger openings 22 for the unit installed further downhole, and smaller openings for other units further uphole so as to progressively remove smaller and smaller cuttings. In the event of a release of the slotted liner 16, the stop ring 46 prevents loss of the slotted liner 16 downhole as it prevents downhole movement when contacting the circulation sub 42 or, alternatively, shoulder 56 in body 20. Thread 58 is used to secure the mill.

In operation, the top sub 10 rotates in tandem with body 30 and stop sub 48. The circulating fluid passes through these three members through passage 60 in a normal circulating mode down to the mill (not shown). After exiting the mill, the fluid, laden with cuttings, comes back uphole through the annular space and its movement is illustrated by arrow 52. Eventually, the cuttings and fluid pass through openings 28 and into annular space 24, where the velocity is reduced and the cuttings drop out by gravity and are caught near the bottom of the annular space 24. The cuttings 54 are ultimately retrieved with the tool. The circulating fluid represented by arrow 52 continues on its path out of annular space 24 through the slots 22 and further uphole, where another apparatus A can be mounted as desired. Alternatively, the circulating fluid goes back to the surface, where it is processed in a known manner.

The cup seal 35 remains stationary and in contact with the wellbore, a part of which is shown schematically as 62. In view of the bearing 36, the body 20 can rotate under the cup seal 35 in tandem with the drillstring, which includes, in part, top sub 10, body 30, and stop sub 48.

Figure 2:
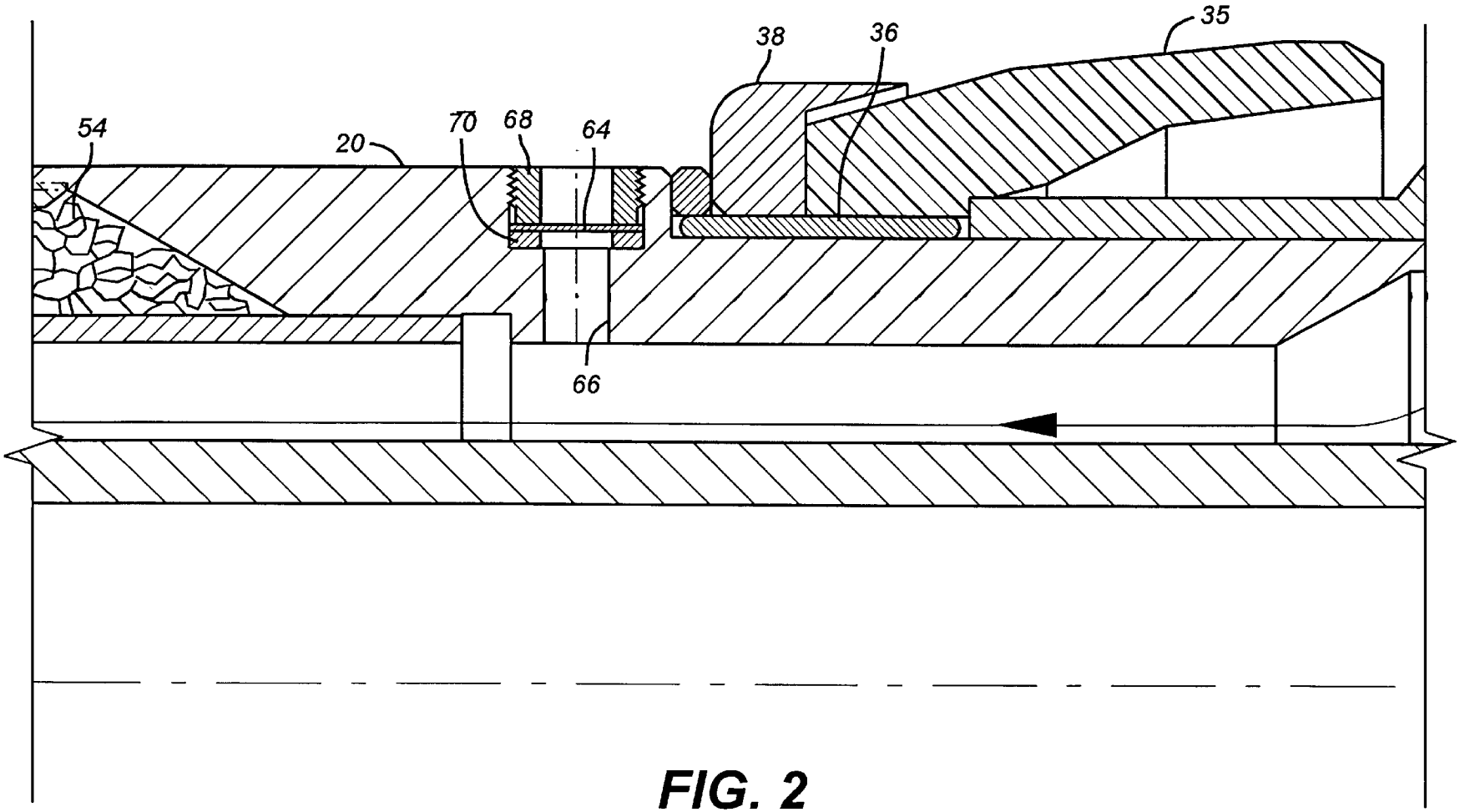
FIG. 2 illustrates a bypass arrangement if the tool becomes plugged, employing a rupture disc.

Optional bypass features can be used if the annular space 24 becomes full of cuttings 54, thus offering backpressure against the flow represented by arrow 52. As shown in FIG. 2, body 20 can have a rupture disc 64 built into an opening 66 in body 20. The rupture disc 64 is retained by a nut 68 and supported by a washer 70, with the rupture disc 64 mounted in between. Upon build-up of excessive pressure in annular passage 34, the rupture disc 64 can break, allowing bypass around annular space 24.

Figure 3:
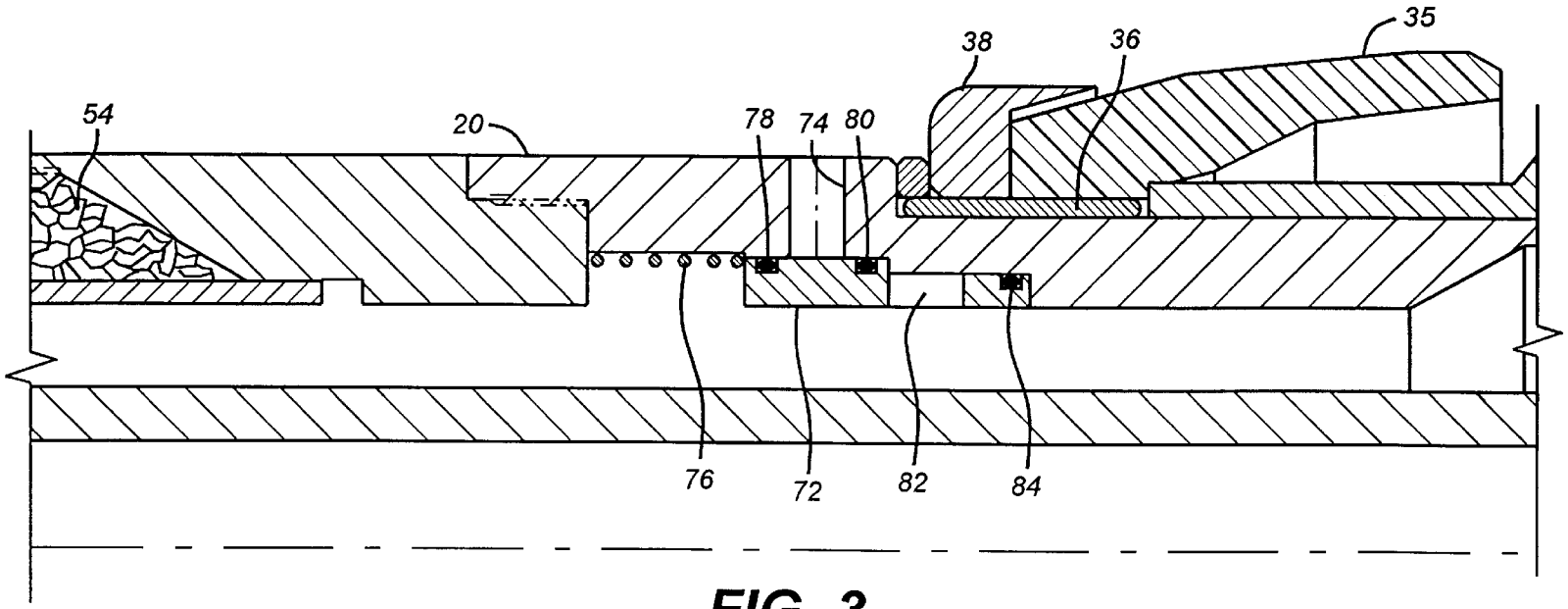
FIG. 3 illustrates an alternative design to the rupture disc shown in FIG. 2, illustrating a movable sleeve as a bypass mechanism for the apparatus.

An alternative design to the bypass arrangement shown in FIG. 2 is illustrated in FIG. 3. There, a piston 72 normally obstructs a port 74 and is biased to the closed position shown in FIG. 3 by a spring 76. Seals 78 and 80 straddle the opening 74 to retain the sealed relationship so as to direct the flow as represented by arrow 52 in FIGS. 1*a* and 1*b*. However, should sufficient internal pressure develop, the force of spring 76 is overcome, shifting the piston 72 so that seal 80 passes beyond opening 74 and exposes slots 82 in the piston 72. At that point, with spring 76 compressed, seal 80 is above opening 74 and seal 84 is below, with openings 82 in between in alignment with passage 74. Thus, the flow in that condition represented by arrow 52, will merely exit outlet port 74 and bypass the annular space 24 should it be clogged up with cuttings 54.

Figure 4:
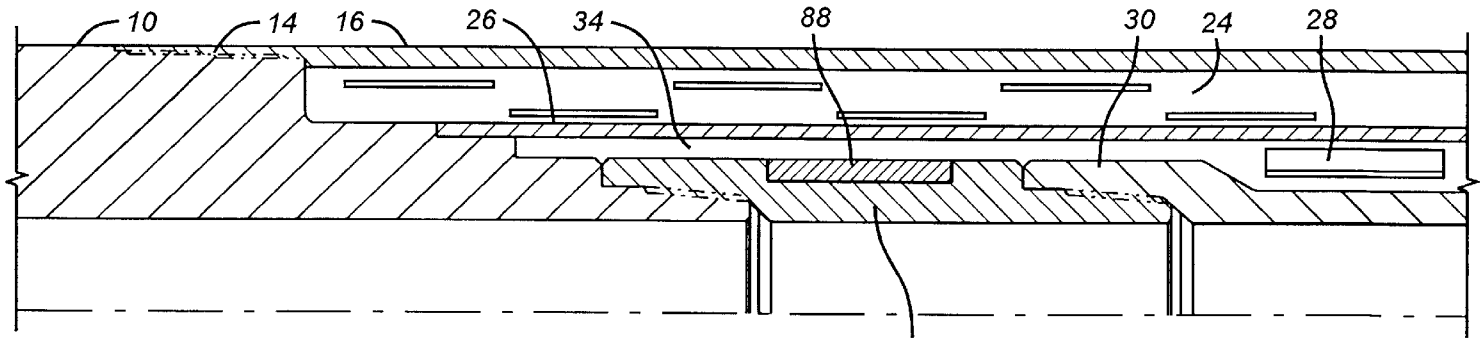
FIG. 4 illustrates the use of a magnetic sub to further assist in capturing cuttings.

FIG. 4 illustrates the use of a magnetic sub 86, having a magnet 88 located on body 30 so as to be exposed to the annular space 34. The magnet 88 can take out fine cuttings and can be especially useful when two or more of the apparatuses are used in series, and the large cuttings have already been previously removed.

Those skilled in the art will appreciate the advantage of the design of the present invention. Normal circulation is employed. A seal, such as a cup seal 35 or a suitably acceptable alternative, directs the circulating fluid in the annulus back through an annular space within the tool. Gravity is then employable to allow the captured particles or cuttings 54 to settle in a zone of reduced velocity. A large capture area in the form of annular space 24 is provided since the outlets 22 are at its upper end. In view of the design of the apparatus A of the present invention, it can be put anywhere in the string and not necessarily be limited to placement immediately above the mill, as in the past. The apparatus A can handle large cuttings and does not require the use of any mechanically operated catch mechanisms to retain the captured cuttings 54. One or more of the apparatuses can be used in series so that large cuttings are removed first, and smaller cuttings removed further uphole. A bypass feature can be incorporated to allow automatic bypass upon build-up of a certain resistance to flow within the tool. This bypass can be accomplished in a number of different ways, such as a rupture disc 64 or a movable piston 72, or other equivalent techniques to open a bypass flowpath from annular space 34.

The foregoing disclosure and description of the invention are illustrative and explanatory thereof, and various changes in the size, shape and materials, as well as in the details of the illustrated construction, may be made without departing from the spirit of the invention.

I claim:

1. A downhole cutting separator, comprising:

a body having a bore therethrough to accommodate flow downhole;

an outer housing on the body defining a return flowpath uphole;

a fluid restrictor on said outer housing to restrict fluid flow downhole and thereby direct returning fluid with cuttings into said return flowpath;

a retaining device in said return flowpath further comprising a receptacle out of said return flowpath in which said cuttings can collect and to allow return flow uphole to bypass said collected cuttings.

2. The separator of claim 1, wherein:

said return flowpath comprises a tortuous path to induce the cuttings to drop from the return fluid passing uphole therethrough.

3. The separator of claim 2, wherein:

said third restricter is rotatably mounted to said outer housing.

4. The separator of claim 3, wherein:

said retaining device comprises a tubular member with a plurality of openings having an uphole and a downhole end.

5. The separator of claim 4, wherein:

said openings are disposed adjacent said uphole end, leaving that portion of said flowpath adjacent said downhole end as a receptacle for dropped cuttings.

6. The separator of claim 5, wherein:

said openings comprise elongated slots.

7. The separator of claim 1, wherein:

said fluid restrictor further comprises a seal;

said seal is rotatably mounted to said outer housing.

8. The separator of claim 7, wherein:

said seal comprises a cup seal.

9. The separator of claim 1, wherein:

said retaining device comprises a tubular member with a plurality of openings having an uphole and a downhole end.

10. The separator of claim 9, wherein:

said openings are disposed adjacent said uphole end, leaving that portion of said flowpath adjacent said downhole end as said receptacle for dropped cuttings.

11. The separator of claim 10, wherein:

said openings comprise elongated slots.

12. The separator of claim 1, further comprising:

a magnetic element in communication with flow in said flowpath to assist in capturing cuttings within said flowpath.

13. A downhole cutting separator, comprising:

a body having a bore therethrough to accommodate flow downhole;

an outer housing on the body defining a return flowpath uphole;

a fluid restrictor on said outer housing to restrict fluid flow downhole and thereby direct returning fluid with cuttings into said return flowpath;

a retaining device in said return flowpath to capture cuttings and allow return flow uphole;

a bypass from said return flowpath through said outer housing, selectively operable on buildup of a predetermined pressure in said return flowpath.

14. The separator of claim 13, wherein:

said bypass comprises a rupture disc.

15. The separator of claim 13, wherein:

said bypass comprises a biased valve element selectively sealingly covering an opening in said outer housing until it is moved by pressure in said return flowpath.

16. A downhole cutting separator, comprising:

a body having a bore therethrough to accommodate flow downhole;

an outer housing on the body defining a return flowpath uphole;

a fluid restrictor on said outer housing to restrict fluid flow downhole and thereby direct returning fluid with cuttings into said return flowpath;

a retaining device in said return flowpath to capture cuttings and allow return flow uphole;

said return flowpath comprises a tortuous path to induce the cutting to drop from the return fluid passing uphole therethrough;

said seal is rotably mounted to said outer housing;

said retaining device comprises a tubular member with a plurality of openings having an uphole and a downhole end;

said openings are disposed adjacent said uphole end, leaving that portion of said flowpath adjacent said downhole end as a receptacle for dropped cuttings;

said openings comprise elongated slots;

a bypass from said return flowpath through said outer housing, selectively operable on buildup of a predetermined pressure in said return flowpath.

17. The separator of claim 16, further comprising:

a magnetic element in communication with flow in said flowpath to assist in capturing cuttings within said flowpath.

18. A downhole cuttings separator system, comprising:

a plurality of bodies, each having a bore therethrough to accommodate flow downhole;

an outer housing on each of said bodies defining a return flowpath uphole on each said body;

a fluid restricter on each said outer housing sealing downhole, thereby directing return fluid with cuttings into that portion of said return flowpath in its respective outer housing;

a retaining device in each said outer housing in said return flowpath therein, wherein as said return flow moves uphole through said housings, smaller cuttings are retained successively in said flowpath in said housings on the way uphole.

19. The system of claim 18, wherein:

said flow restrictors further comprise seals;

said seals are rotatably mounted to their respective housings.

20. The system of claim 19, wherein:

said retaining devices comprise tubular members with a plurality of openings, where the openings in each tubular member are bigger than the openings in a corresponding tubular member uphole from it;

each said outer housing comprises a bypass from said return flowpath through said outer housing, selectively operable on buildup of a predetermined pressure in said return flowpath.

* * * * *

UNITED STATES PATENT AND TRADEMARK OFFICE

CERTIFICATE OF CORRECTION

PATENT NO. : 6,176,311 B1
DATED : January 23, 2001
INVENTOR(S) : Jimmy Don Ryan

It is certified that error appears in the above-identified patent and that said Letters Patent is hereby corrected as shown below:

Column 4,
Line 61, delete claim 3 and replace with:
3. The separator of claim 1, wherein
said fluid restrictor comprises a seal;
said seal is rotatably mounted to said outer housing.

Column 6,
Line 9, delete “seal” and insert -- fluid restrictor --.

Signed and Sealed this

Twenty-first Day of January, 2003

JAMES E. ROGAN
*Director of the United States Patent and Trademark Office*